US011658395B2

(12) United States Patent
Kim et al.

(10) Patent No.: US 11,658,395 B2
(45) Date of Patent: May 23, 2023

(54) ANTENNA PACKAGE AND IMAGE DISPLAY DEVICE INCLUDING THE SAME

(71) Applicant: DONGWOO FINE-CHEM CO., LTD., Jeollabuk-do (KR)

(72) Inventors: Na Yeon Kim, Seoul (KR); Seung Hyun Shin, Seoul (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 8 days.

(21) Appl. No.: 17/545,154

(22) Filed: Dec. 8, 2021

(65) Prior Publication Data

US 2022/0190467 A1 Jun. 16, 2022

(30) Foreign Application Priority Data

Dec. 11, 2020 (KR) ..... 10-2020-0173089

(51) Int. Cl.

| | |
|---|---|
| ***H01Q 1/48*** | (2006.01) |
| ***H01Q 1/24*** | (2006.01) |
| ***H01Q 1/38*** | (2006.01) |
| *H01Q 1/22* | (2006.01) |

(52) U.S. Cl.

CPC ..... *H01Q 1/243* (2013.01); *H01Q 1/38* (2013.01); *H01Q 1/48* (2013.01); *H01Q 1/2283* (2013.01)

(58) Field of Classification Search

CPC .. H01Q 1/24; H01Q 1/38; H01Q 1/48; H01Q 1/22

See application file for complete search history.

(56) References Cited

U.S. PATENT DOCUMENTS

2015/0070219 A1* 3/2015 Dinh ..... H01Q 1/085 343/893
2015/0091761 A1* 4/2015 van Niekerk ..... H01Q 1/48 343/702
2015/0351273 A1* 12/2015 Kiple ..... H01Q 1/42 343/702

FOREIGN PATENT DOCUMENTS

KR 10-2013-0095451 A 8/2013

* cited by examiner

*Primary Examiner* — Andrea Lindgren Baltzell
(74) *Attorney, Agent, or Firm* — The PL Law Group, PLLC

(57) ABSTRACT

An antenna package according to an embodiment of the present disclosure includes an antenna device including a dielectric layer and an antenna unit disposed on the dielectric layer, and a circuit board. The antenna unit includes a radiator and a transmission line extending from the radiator. The circuit board includes a core layer and a signal wiring disposed on the core layer and electrically connected to the antenna unit. The circuit board has a bonding region adhered to the antenna device, a signal transmission region including the signal wiring and a connect region including a connector connected to a terminal end portion of the signal wiring. A length of the transmission line of the antenna unit is greater than or equal to a length of the signal transmission region of the circuit board.

16 Claims, 6 Drawing Sheets

ANTENNA PACKAGE AND IMAGE DISPLAY DEVICE INCLUDING THE SAME

CROSS-REFERENCE TO RELATED APPLICATION AND CLAIM OF PRIORITY

This application claims priority to Korean Patent Application No. 10-2020-0173089 filed on Dec. 11, 2020 in the Korean Intellectual Property Office (KIPO), the entire disclosures of which are incorporated by reference herein.

BACKGROUND

1. Field

The present invention relates to an antenna package and an image display device including the same. More particularly, the present invention relates to an antenna package including an antenna device and a circuit board and an image display device including the same.

2. Description of the Related Art

As information technologies have been developed, a wireless communication technology such as Wi-Fi, Bluetooth, etc., is combined with an image display device in, e.g., a smartphone form. In this case, an antenna may be combined with the image display device to provide a communication function.

According to developments of a mobile communication technology, an antenna capable of implementing, e.g., high frequency or ultra-high frequency band communication is needed in the display device.

A circuit board for a power feeding and a transmission of control signal may be connected to the antenna for a radiation driving of the antenna. The circuit board may be bent to be connected to, e.g., a driving integrated circuit chip. In this case, damages to circuit wirings and bonding failures with the antenna due to a bending stress may be caused. Additionally, power loss and signal loss to the antenna may occur due to the circuit board, and signal noises may also be generated due to the circuit board.

Further, as a thickness of the image display device to which the antenna is coupled recently decreases, a degree of bending of the circuit board may also increase. In this case, the above-described bending defects may be further aggravated. Thus, a construction of an antenna package to achieve a bending reliability of the circuit board while maintaining or improving radiation properties of the antenna is needed.

For example, Korean Published Patent Application No. 2013-0095451 discloses an antenna integrated into a display panel, but does not suggest the efficient circuit connection as described above.

SUMMARY

According to an aspect of the present invention, there is provided an antenna package having improved electrical and mechanical reliability.

According to an aspect of the present invention, there is provided an image display device including an antenna package with improved electrical and mechanical reliability.

(1) An antenna package, including: an antenna device comprising a dielectric layer and an antenna unit disposed on the dielectric layer, the antenna unit including a radiator and a transmission line extending from the radiator; and a circuit board including a core layer and a signal wiring disposed on the core layer and electrically connected to the antenna unit, wherein the circuit board has a bonding region adhered to the antenna device, a signal transmission region including the signal wiring and a connect region including a connector connected to a terminal end portion of the signal wiring, and a length of the transmission line of the antenna unit is greater than or equal to a length of the signal transmission region of the circuit board.

(2) The antenna package of the above (1), wherein the antenna device has a radiation region in which the radiator is disposed and a transmission region in which the transmission line is disposed, and a length of the transmission region of the antenna device is equal to or greater than the length of the signal transmission region of the circuit board.

(3) The antenna package of the above (2), wherein the transmission region of the antenna device includes a bending region.

(4) The antenna package of the above (3), wherein the antenna device further comprises an antenna ground layer facing the transmission line with the dielectric layer interposed therebetween in the bending region.

(5) The antenna package of the above (1), wherein an area of the signal transmission region is from 50% to 65% of an area of the circuit board in a planar view, and an area of the connector region is from 30% to 40% of the area of the circuit board in the planar view.

(6) The antenna package of the above (1), wherein the length of the transmission line of the antenna device is equal to or greater than the length of the signal wiring of the circuit board.

(7) The antenna package of the above (6), wherein the antenna unit includes a plurality of antenna units arranged in a width direction, and the signal wiring of the circuit board is individually connected to the transmission line included in each of the plurality of antenna units.

(8) The antenna package of the above (1), wherein the antenna unit further includes a signal pad electrically connected to an end potion of transmission line in the bonding region; and a ground pad disposed around the signal pad and spaced apart from the transmission line and the signal pad.

(9) The antenna package of the above (8), wherein the circuit board further includes a bonding pad disposed around the signal wiring in the bonding region and electrically connected to the ground pad.

(10) The antenna package of the above (9), wherein the circuit board further includes a ground layer facing the signal wiring in a thickness direction with the core layer interposed therebetween.

(11) The antenna package of the above (10), further including a via structure penetrating the core layer to electrically connect the bonding pad and the ground layer with each other.

(12) The antenna package of the above (1), further including a driving integrated circuit chip electrically connected to the antenna unit through the connector.

(13) The antenna package of the above (12), further including a chip mounting board on which the driving integrated circuit chip is mounted, the chip mounting board comprising a chip connector coupled to the connector.

(14) An image display device, including: a display panel; and the antenna package according to embodiments as described above disposed on the display panel.

(15) The image display device of the above (14), wherein the radiator of the antenna device is disposed on a front portion of the display panel, and a portion of the antenna device in which the transmission line is disposed is bent toward a rear portion of the display panel.

(16) The image display device of the above (15), wherein the circuit board and the antenna device are bonded to each other at the rear portion of the display panel.

According to embodiments of the present invention, a length of a transmission line included in an antenna device may be formed to be greater than or equal to a length of a signal wiring included in a circuit board. Accordingly, a length or an area of the circuit board having a relatively thick or multi-layered structure may be reduced, thereby improving productivity of the antenna package.

In some embodiments, a length of a transmission region of the antenna device may be increased, so that the antenna device may be bent through the transmission region to electrically connect a driving integrated circuit chip and an antenna unit with each other. Accordingly, flexural stability and bonding stability in a bent portion may be improved.

In some embodiments, the circuit board may include a connector region on which a connector is mounted. The length of the signal wiring of the circuit board may be reduced, so that a sufficient area of the connector region may be obtained. Accordingly, stability and reliability of the connection with the driving integrated circuit chip may be improved.

DETAILED DESCRIPTION

According to exemplary embodiments of the present invention, there is provided an antenna package including a combination of a circuit board and an antenna device that includes an antenna unit. According to exemplary embodiments of the present invention, there is also provided an image display device including the antenna package.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

The terms "first", "second", "upper", "lower", "top", "bottom", etc., used herein do not designate an absolute position, but are relatively used to distinguish different elements or different positions.

Figure 1:
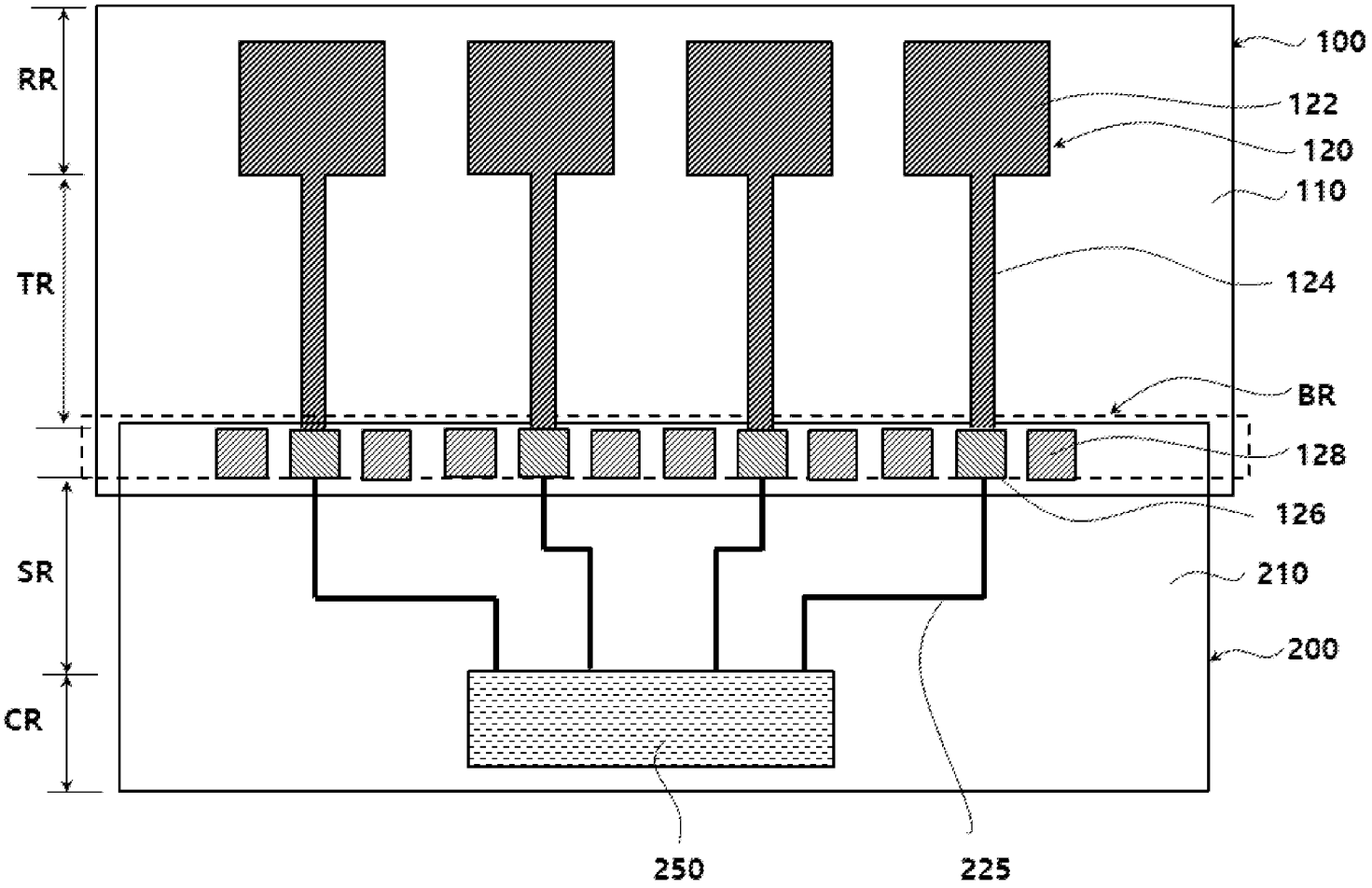
FIGS. 1 and 2 are a schematic top planar view and a schematic cross-sectional view, respectively, illustrating an antenna package in accordance with exemplary embodiments.

Referring to FIG. 1, the antenna package may include an antenna device 100 and a circuit board 200. The circuit board 200 may include a core layer 210 and a circuit wiring layer 220 formed on the core layer 210. The circuit wiring layer 220 and an antenna unit 120 included in the antenna device 100 may be electrically connected to each other.

The antenna device 100 may include an antenna dielectric layer 110 and the antenna unit 120 disposed on the antenna dielectric layer 110.

The antenna dielectric layer 110 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth)acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acrylic urethane-based resin; a silicone-based resin, etc. These may be used alone or in a combination of two or more therefrom.

For example, the antenna dielectric layer 110 may include a cyclic olefin polymer (COP).

In some embodiments, an adhesive film such as an optically clear adhesive (OCA) or an optically clear resin (OCR) may be included in the antenna dielectric layer 110. In some embodiments, the antenna dielectric layer 110 may include an inorganic insulating material such as silicon oxide, silicon nitride, silicon oxynitride, glass, or the like.

In some embodiments, a dielectric constant of the antenna dielectric layer 110 may be adjusted in a range from about 1.5 to about 12. When the dielectric constant exceeds about 12, a driving frequency may be excessively decreased, so that driving in a desired high or ultra-high frequency band may not be implemented.

The antenna unit 120 may be formed on a top surface of the antenna dielectric layer 110. For example, a plurality of the antenna units 120 may be arranged in an array form along a width direction of the antenna dielectric layer 110 or the antenna package to form an antenna pattern row.

The antenna unit 120 may include a radiator 122 and a transmission line 124. The radiator 122 may have, e.g., a polygonal plate shape, and the transmission line 124 may extend from a side of the radiator 122. The transmission line 124 may be formed as a single member substantially integral with the radiator 122.

The antenna unit 120 may further include a signal pad 126. The signal pad 126 may be connected to one end portion of the transmission line 124. In an embodiment, the signal pad 126 may be formed as a member substantially integral with the transmission line 124, and an terminal end portion of the transmission line 124 may serve as the signal pad 126.

In some embodiments, a ground pad 128 may be disposed around the signal pad 126. For example, a pair of ground pads 128 may be disposed to face each other with the signal pad 126 interposed therebetween.

For example, the ground pad 128 may be electrically and physically separated from the transmission line 124 and the signal pad 126.

In exemplary embodiments, the antenna unit or the radiator 122 may be designed to have a resonance frequency corresponding to high frequency or ultra-high frequency band such as 3G, 4G, 5G or higher band. In a non-limiting example, the resonance frequency of the antenna unit may be about 10 GHz or more, or from about 20 GHz to 40 GHz (e.g., about 28 GHz or about 38 GHz).

The antenna unit 120 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals. These may be used alone or in combination thereof.

In an embodiment, the antenna unit may include silver (Ag) or a silver alloy (e.g., silver-palladium-copper (APC)), or copper (Cu) or a copper alloy (e.g., a copper-calcium (CuCa)) to implement a low resistance and a fine line width pattern.

In some embodiments, the antenna unit 120 may include a transparent conductive oxide such as indium tin oxide (ITO), indium zinc oxide (IZO), zinc oxide (ZnOx), indium zinc tin oxide (IZTO), etc.

In some embodiments, the antenna unit 120 may include a stacked structure of a transparent conductive oxide layer and a metal layer. For example, the antenna unit may include a double-layered structure of a transparent conductive oxide layer-metal layer, or a triple-layered structure of a transparent conductive oxide layer-metal layer-transparent conductive oxide layer. In this case, flexible property may be improved by the metal layer, and a signal transmission speed may also be improved by a low resistance of the metal layer. Corrosive resistance and transparency may be improved by the transparent conductive oxide layer.

In some embodiments, the radiator 122 and the transmission line 124 may have a mesh structure to improve a transmittance. In this case, a dummy mesh pattern (not illustrated) may be formed around the radiator 122 and the transmission line 124.

The signal pad 126 and the ground pad 128 may be a solid pattern formed of the above-described metal or alloy in consideration of a feeding resistance reduction, a noise absorption efficiency, etc. In an embodiment, at least a portion of the transmission line 124 may include a solid structure.

The antenna unit 120 may include a blackened portion, so that a reflectance at a surface of the antenna unit 120 may be decreased to suppress a visual recognition of the antenna unit due to a light reflectance.

In an embodiment, a surface of the metal layer included in the antenna unit 120 may be converted into a metal oxide or a metal sulfide to form a blackened layer. In an embodiment, a blackened layer such as a black material coating layer or a plating layer may be formed on the antenna unit 120 or the metal layer. The black material or plating layer may include silicon, carbon, copper, molybdenum, tin, chromium, molybdenum, nickel, cobalt, or an oxide, sulfide or alloy containing at least one therefrom.

A composition and a thickness of the blackened layer may be adjusted in consideration of a reflectance reduction effect and an antenna radiation property.

The circuit board 200 may include a core layer 210 and a circuit wiring layer 220 formed on a surface of the core layer 210. The circuit board 200 may be fabricated from, e.g., a flexible printed circuit board (FPCB).

The core layer 210 may include a flexible resin such as a polyimide resin, a modified polyimide (MPI), an epoxy resin, polyester, a cycloolefin polymer (COP), a liquid crystal polymer (LCP), or the like. In an embodiment, the core layer 210 may be formed of the LCP in consideration of a dielectric loss in the core layer 210 or the circuit board. The core layer 210 may include an internal insulating layer included in the circuit board 200.

For example, the circuit wiring layer 220 may be formed on a top surface of the core layer 210. For example, the circuit board 200 may further include a cover-lay film formed on the top surface of the core layer 210 and covering the circuit wiring layer 220. In an embodiment, the cover-lay film may be formed on the top surface of the core layer 210 through an adhesive layer.

The circuit wiring layer 220 may include a signal wiring 225. The signal wiring 225 may serve as, e.g., an antenna feeding wiring or a driving signal wiring. For example, one end portion of the signal wiring 225 may be exposed by partially removing the cover-lay film of the circuit board 200. The exposed one end portion of the signal wiring 225 may be bonded to the signal pad 126.

For example, a conductive intermediate structure 150 such as an anisotropic conductive film (ACF) may be attached commonly on the signal pads 126 and the ground pads 128, and a bonding region BR of the circuit board 200 at which the one end portions of the signal wiring 225 are located may be disposed on the conductive intermediate structure 150. Thereafter, the bonding region BR of the circuit board 200 may be attached to the antenna device 100 by a heat treatment/pressurization process so that the signal wiring 225 may be electrically connected to each signal pad 126.

Noises from the signal pad 126 may be shielded or absorbed by the ground pad 128. Further, the ground pads 128 may be arranged around the signal pad 126, so that an adhesive force to the anisotropic conductive film (ACF) may be increased, and bonding stability may be improved.

As illustrated in FIG. 1, each of the signal wirings 225 may be individually and independently connected to the antenna unit 120. Accordingly, feeding/driving control may be independently performed for each of the plurality of antenna units 120. For example, different phase signals may be applied to the antenna units 120 through the signal wirings 225 connected to each of the plurality of the antenna units 120.

As illustrated in FIG. 1, the antenna device 100 or the antenna dielectric layer 110 may include a radiation region RR, a transmission region TR and a bonding region BR. The circuit board 200 may include the bonding region BR, a signal transmission region SR and a connector region CR.

The radiation region RR of the antenna device 100 may be a region in which the radiator 122 is disposed. For example, the radiation region RR may cover a length from one side of the antenna dielectric layer 110 to a boundary between the radiator 122 and the transmission line 124.

The transmission region TR of the antenna device 100 may be an area in which the transmission line 124 extends. In some embodiments, the transmission region TR may cover a length from the boundary between the radiator 122 and the transmission line 124 to one side of the signal pad 126. In an embodiment, a length of the transmission line 124 may be substantially the same as the length of the transmission region TR.

The bonding region BR may be a region in which the signal pad 126 and the ground pad 128 are disposed. As illustrated in FIG. 1, the antenna device 100 and the circuit board 200 may share the bonding region BR. The signal pad 126 and the signal wiring 225 may be electrically connected to each other through the bonding region BR.

The bonding region BR of the circuit board 200 may include one end portion of the circuit board 200 adjacent to the antenna device 100.

The signal transmission region SR of the circuit board 200 may be a region in which the signal wiring 225 is disposed. The connector region CR may be a region in which a connector 250 for an electrical connection with a driving integrated circuit chip 310 is disposed. For example, the connector region CR may be a region from a boundary between the signal wiring 225 and the connector 250 to the other end portion of the circuit board 200.

In exemplary embodiments, a length of the transmission region TR of the antenna device 100 may be greater than or equal to a length of the signal transmission region SR of the circuit board 200. Preferably, the length of the transmission region TR of the antenna device 100 may be greater than the length of the signal transmission region SR of the circuit board 200.

Accordingly, the length of the transmission line 124 of the antenna unit 120 may be greater than or equal to the length of the signal wiring 225 of the circuit board 200. Preferably, the length of the transmission line 124 of the antenna unit 120 may be greater than the length of the signal wiring 225 of the circuit board 200.

As illustrated in FIG. 1, when the signal wiring 225 may have a bent shape, the length of the signal wiring 225 used in the present application may be a length in a longitudinal direction of the circuit board 200 (or in an extension direction of the transmission line 124). In an embodiment, the signal wiring 225 may have a straight shape in the longitudinal direction.

A size and a circuit design of the antenna package may also be changed according to a size and a design of an image display device to which the antenna package is applied. For example, when the length or size of the circuit board 200 is increased, an additional circuit board manufacturing cost is required, and an overall productivity may be lowered by the circuit board 200 including a multi-layered structure.

However, according to the above-described exemplary embodiments, the length of the transmission line 124 of the antenna device 100 may be relatively increased. Accordingly, the size of the circuit board 200 may be modified to have a reduced signal transmission region SR. Thus, an overall productivity of the antenna package may be improved.

In an embodiment, the circuit board 200 may be fixed to a predetermined size, and the length of the transmission line 124 or the antenna device 100 may be changed according to the design of the display device to improve a degree of freedom in the design of the antenna package.

Figure 2:
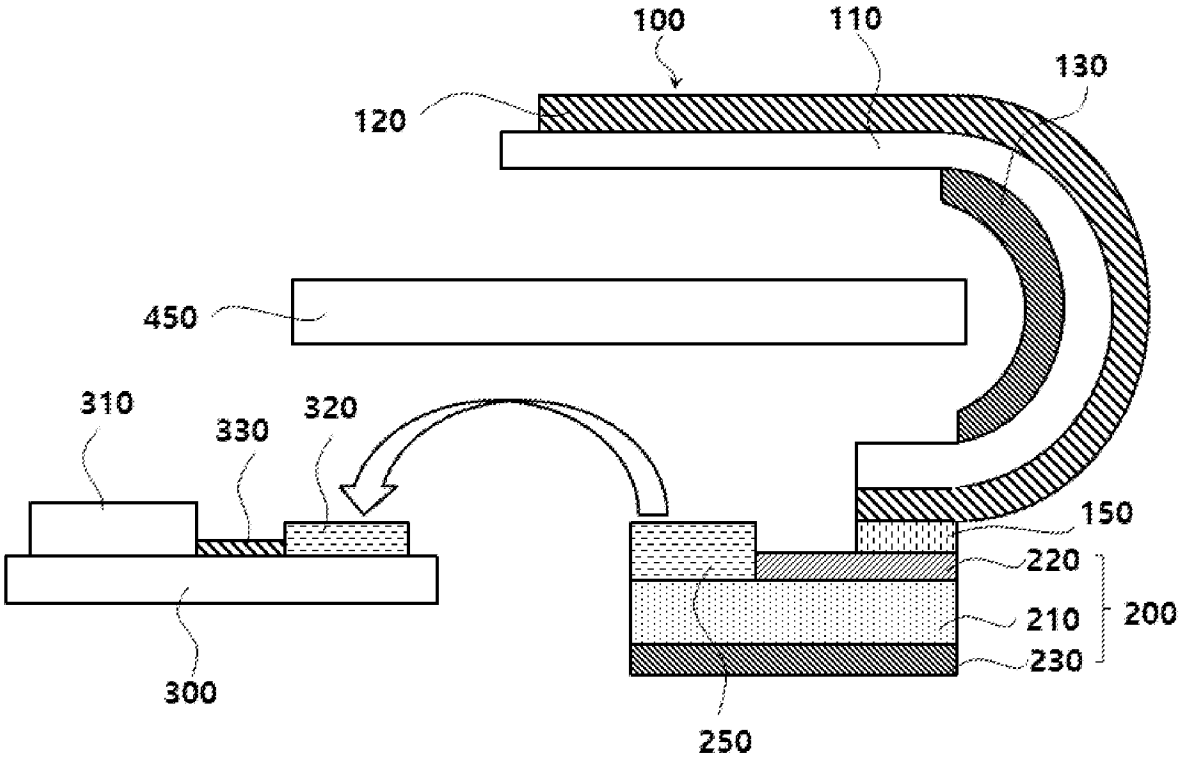

As illustrated in FIG. 2, the antenna device 100 may be bent using the increased length of the transmission line 124. For example, a portion of the antenna device 100 in the transmission region TR may be bent to dispose the bonding region BR under a display panel 450 (e.g., toward a rear side of the display panel 450).

Accordingly, the circuit board 200 may not be bent and may be electrically connected to the antenna unit 120 through the bonding area BR of the antenna device 100 under the display panel 450.

When the circuit board 200 having a relatively thick or a multi-layered structure is bent under the display panel 450, a bending stability with the antenna device 100 may be degraded. Further, a mechanical stability of insulating and conductive structures included in the circuit board 200 may also be degraded.

However, according to exemplary embodiments, the antenna device 100 may be bent by using the transmission region TR having the increased length. Accordingly, bending properties may be improved without degrading the bonding stability and mechanical stability of the circuit board 200.

Additionally, the length of the circuit board 200 may be relatively decreased, so that an intermediate power loss or a dielectric loss occurring in the circuit board 200 may be reduced or prevented. Accordingly, radiation reliability and efficiency of the antenna device 100 may be improved.

A connection to the driving integrated circuit chip 310 may be implemented through the connector 250 mounted on the circuit board 200 at the rear side of the display panel 450.

In some embodiments, the driving integrated circuit chip 310 may be mounted on a chip mounting board 300. A chip connector 320 may be disposed on the chip mounting board 300, and the driving integrated circuit chip 310 and the chip connector 320 may be electrically connected through a connection wiring 330.

The connector 250 mounted on the circuit board 200 may be coupled to the chip connector 320 mounted on the chip mounting board 300. Accordingly, an electrical connection between the antenna unit 120 and the driving integrated circuit chip 310 may be implemented, and a feeding and control signal transfer to the antenna unit 120 may be performed by the driving integrated circuit chip 310.

In some exemplary embodiments, an area (or a length) of the connector region CR of an area of the circuit board 200 in a planar view may be from about 30% to 40%, and an area (or a length) of the signal transmission region SR may be from about 50% to 65%. As described above, the length of the signal transmission region SR may be relatively reduced, the connector region CR having a sufficient area may be obtained. Accordingly, a connection resistance with the chip connector 320 may be reduced and an overall signal transmission efficiency may be improved.

In an embodiment, an area of the bonding region BR of the area of the circuit board 200 in the planar view may be from about 5% to 10%.

In some embodiments, the antenna device 100 may include an antenna ground layer 130, and the circuit board 200 may include a circuit ground layer 230.

The antenna ground layer 130 may be disposed on a bottom surface of the antenna dielectric layer 110 to face the transmission line 124 with the antenna dielectric layer 110 interposed therebetween.

For example, the antenna ground layer 130 may be bent together with the transmission region TR or the transmission line 124.

In some embodiments, a conductive member of the display device to which the antenna device is applied may serve as a ground layer for the radiator 122.

The conductive member may include, e.g., a gate electrode of a thin film transistor (TFT), various wirings such as, a scan line or a data line, or various electrodes such as a pixel electrode and a common electrode.

In an embodiment, various structures including, e.g., a conductive material disposed under the display panel 450 may serve as a ground layer for the radiator 122. For example, a metal plate (e.g., a stainless-steel plate such as a SUS plate), a pressure sensor, a fingerprint sensor, an electromagnetic wave shielding layer, a heat dissipation sheet, a digitizer, etc., may serve as the antenna ground layer 130.

The circuit ground layer 230 may be disposed on a bottom surface of the core layer 210 to overlap the signal wiring 220 in a planar view. The circuit ground layer 230 may face the signal wiring 220 with the core layer 210 interposed therebetween, so that a formation of an electric field around the signal wiring 220 may be promoted, noises may be absorbed and a feeding efficiency may be improved.

Figure 3:
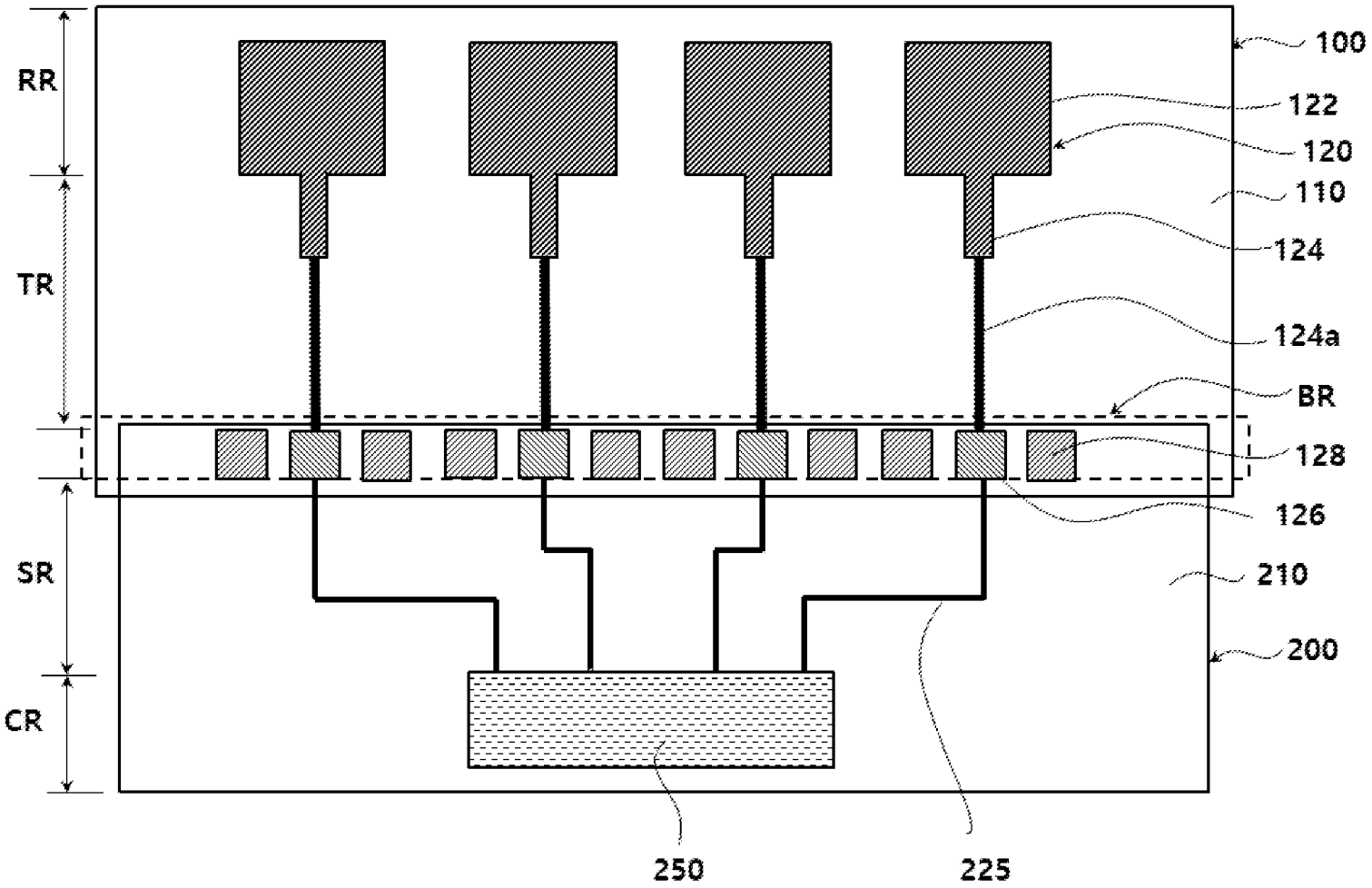
FIG. 3 is a schematic top planar view illustrating an antenna package in accordance with some exemplary embodiments.

FIG. 3 is a schematic top planar view illustrating an antenna package in accordance with some exemplary embodiments. Detailed descriptions of elements and structures substantially the same as or similar to those described with reference to FIGS. 1 and 2 are omitted herein.

Referring to FIG. 3, the transmission line 124 may include a narrowed portion 124*a* having a reduced width. For example, an end portion of the transmission line 124 adjacent to the signal pad 126 may become narrower to serve as the narrowed portion 124*a*.

The transmission line 124 may have a variable width, so that flexibility and bending property in the transmission region TR may be further improved.

Figure 4:
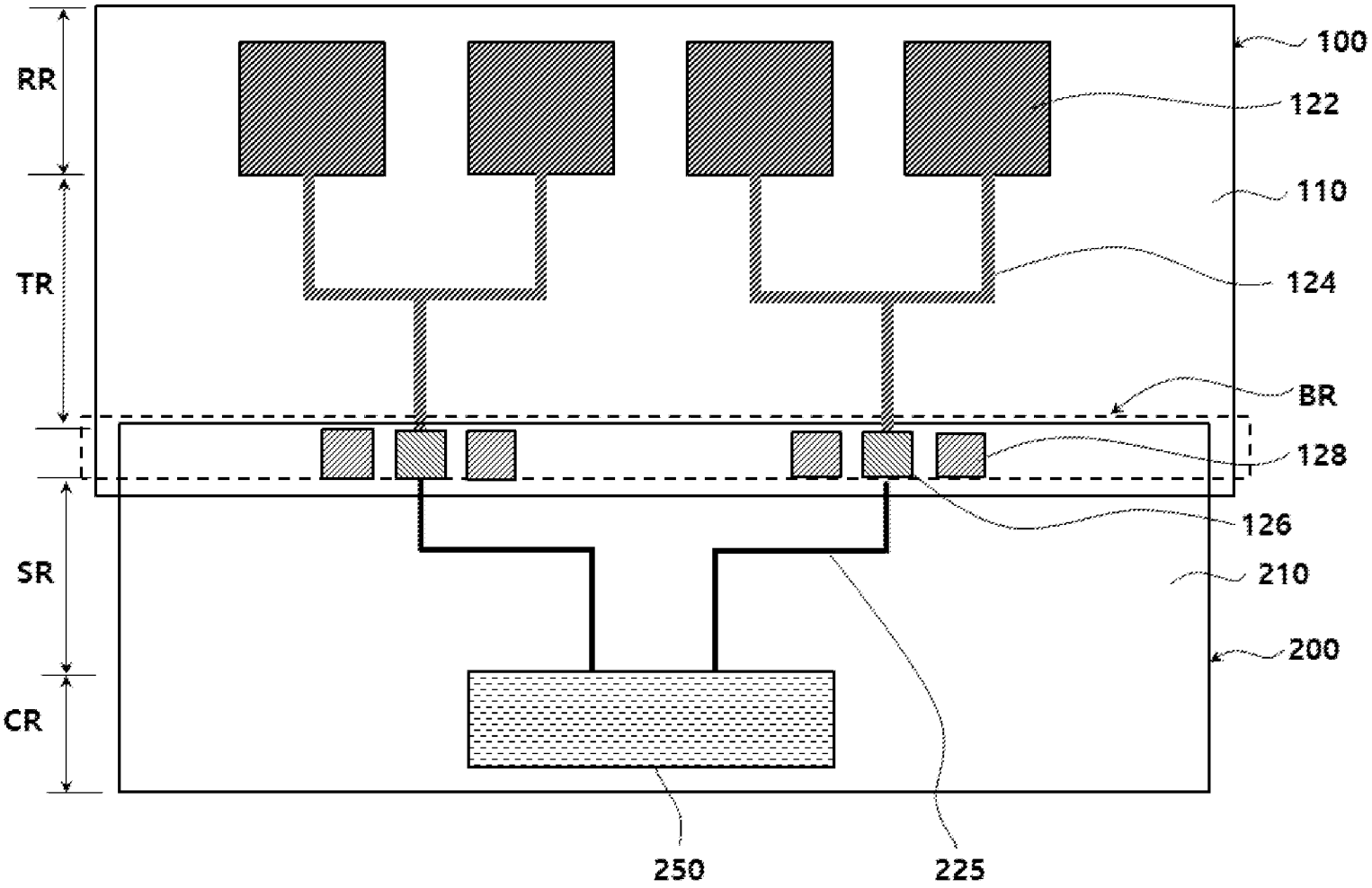
FIG. 4 is a schematic top planar view illustrating an antenna package in accordance with some exemplary embodiments.

FIG. 4 is a schematic top planar view illustrating an antenna package in accordance with some exemplary embodiments. Detailed descriptions of elements and structures substantially the same as or similar to those described with reference to FIGS. 1 and 2 are omitted herein.

Referring to FIG. 4, two or more radiators 122 may be coupled by a transmission line 124. For example, two radiators 122 may be coupled to each other by the transmission line 124 to form a radiation group. One radiation group may be connected to the signal wiring line 225 through the signal pad 126.

As described above, the length of the transmission line 124 (the length in the longitudinal direction of the antenna device or the antenna package) may be greater than or equal to the length of the signal wiring 225.

Figure 5:
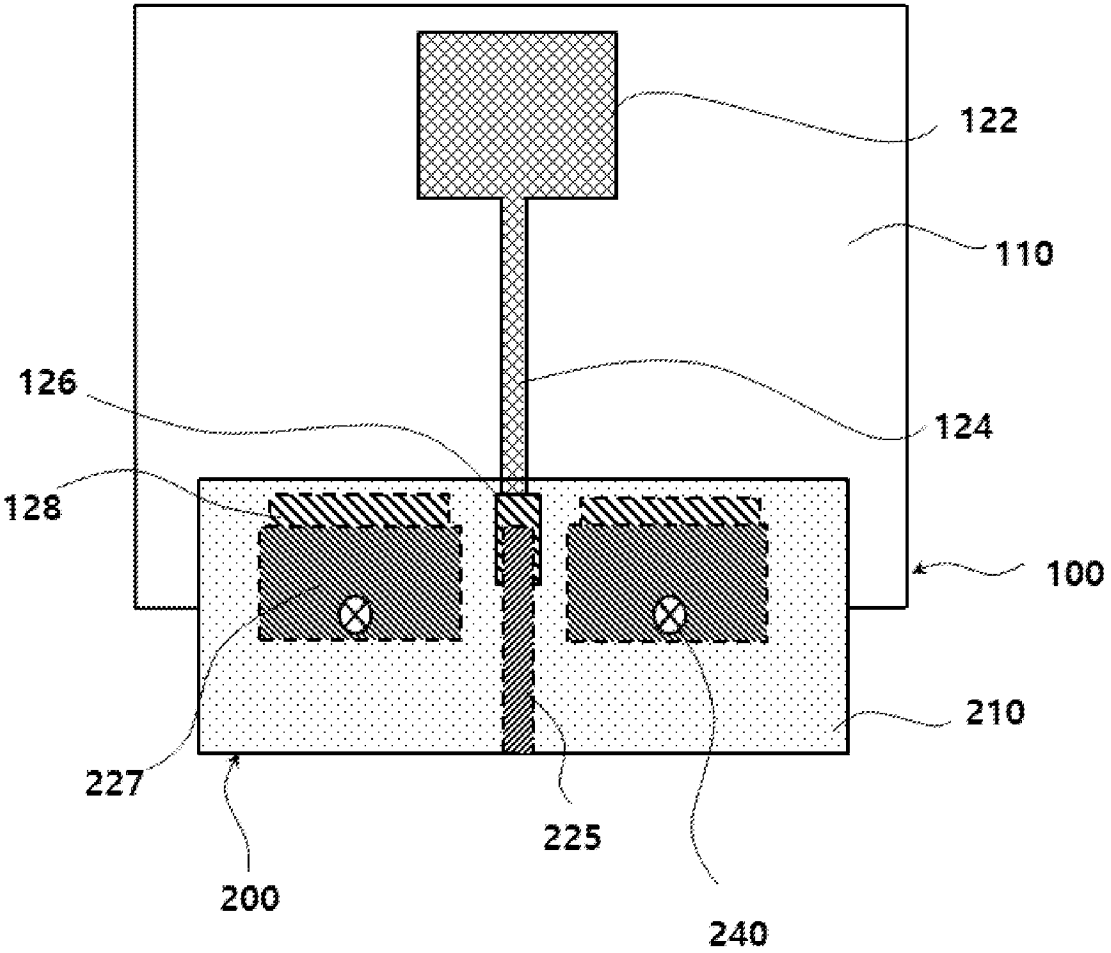
FIG. 5 is a schematic top planar view illustrating an antenna package in accordance with some exemplary embodiments.

FIG. 5 is a schematic top planar view illustrating an antenna package in accordance with some exemplary embodiments. For convenience of descriptions, illustration of the circuit ground layer 230 (see FIG. 2) is omitted in FIG. 5.

Referring to FIG. 5, the circuit board 200 or the circuit wiring layer 220 may further include a bonding pad 227 formed around the signal wiring 220.

The bonding pad 227 may be formed on the top surface of the core layer 210. For example, a pair of the bonding pads 227 may be disposed with one signal wiring 225 interposed therebetween.

The bonding pad 227 may be electrically and physically separated from the signal wiring 225, and may be bonded to the ground pad 128 included in the antenna device 100 via the conductive intermediate structure 150 (see FIG. 2). The bonding pad 227 may be included in the bonding region BR of the circuit board 200, so that bonding stability between the circuit board 200 and the antenna device 100 may be further improved.

In some embodiments, the bonding pad 227 may be electrically connected to the circuit ground layer 230 through a via structure 240 penetrating the core layer 210. Accordingly, grounding efficiency through the bonding pad 227 and the circuit ground layer 230 may be improved.

Figure 6:
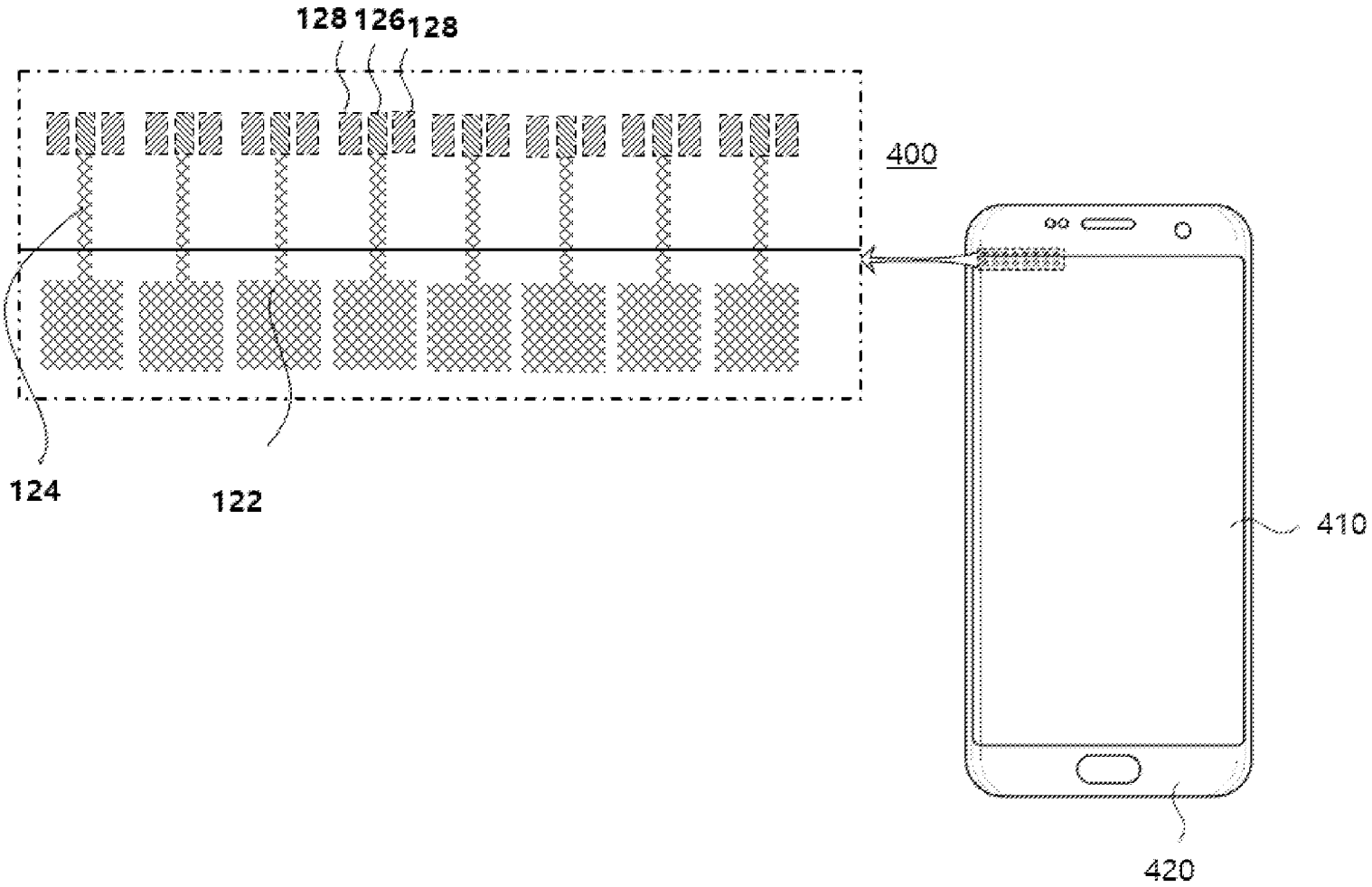
FIG. 6 is a schematic top planar view illustrating an image display device in accordance with exemplary embodiments.

FIG. 6 is a schematic top planar view illustrating an image display device in accordance with exemplary embodiments.

Referring to FIG. 6, an image display device 400 may be fabricated in the form of, e.g., a smart phone, and FIG. 6 illustrates a front portion or a window surface of the image display device 400. The front portion of the image display device 400 may include a display area 410 and a peripheral area 420. The peripheral area 420 may correspond to, e.g., a light-shielding area or a bezel area of the image display device.

The antenna device 100 included in the above-described antenna package may be disposed toward the front portion of the image display device 400. For example, the antenna device 100 may be disposed on the display panel 405. In an embodiment, the radiator 122 may at least partially disposed in the display area 410 in a planar view.

In this case, the radiator 122 may include a mesh-pattern structure, and a decrease of transmittance due to the radiator 122 may be prevented. The driving integrated circuit chip 310 included in the antenna package may be disposed in the peripheral area 420 to prevent image quality deterioration in the display area 410.

Although not illustrated in detail in FIG. 6, as described with reference to FIG. 2, the transmission region including the transmission line 124 and the bonding region including the pads 126 and 128 of the antenna device 100 may be bent to a rear portion of the display panel.

In some embodiments, the antenna package may be bent along the peripheral area 420 using the transmission region TR of the antenna device having an increased length. Accordingly, the circuit board 200 and the driving integrated circuit chip 310 may be electrically connected at the rear portion of the image display device 400.

Hereinafter, preferred embodiments are proposed to more concretely describe the present invention. However, the following examples are only given for illustrating the present invention and those skilled in the related art will obviously understand that various alterations and modifications are possible within the scope and spirit of the present invention. Such alterations and modifications are duly included in the appended claims.

EXAMPLE

An antenna unit was formed using an APC alloy on a COP dielectric layer. Specifically, a size of the radiator was 2.8 mm×2.8 mm, and a size of a transmission line was 1.0 mm (width)×10 mm (length), and two antenna units were arranged on the dielectric layer.

A flexible printed circuit board (FPCB) (total thickness: 500 μm) including circuit wirings on an LCP core layer was prepared. A length of a bonding region of the FPCB was adjusted to be 1 mm, a length of the signal transmission region was 8 mm, and a length of the connector region to be 5 mm.

The FPCB was connected to the transmission lines of the antenna units through the bonding region of the FPCB, and a portion of the COP dielectric layer portion where the transmission lines were arranged was bent downwardly to connect the connector included in the FPCB to a main board.

Comparative Example

An antenna package was manufactured by the same method as that in Example, except that the length of the transmission line of the antenna unit pattern was changed to 5 mm and the length of the signal transmission region of the FPCB was changed to 15 mm, and the signal transmission region of the FPCB was bent and connected to the main board.

Experimental Example

A feeding was performed to the antenna units included in each antenna package of Example and Comparative Example, and S-parameter (S11) and antenna gain were measured at 28 GHz using a network analyzer and a mmWave measuring instrument (C&G Microwave).

The evaluation results are shown in Table 1 below.

TABLE 1

| | S11 (dB) | Antenna Gain (dBi) |
|---|---|---|
| Example | −8.1 | 4.6 |
| Comparative Example | −8.2 | 4.0 |

Referring to Table 1, in Example where the length of the transmission region of the antenna device was increased and the transmission region was bent for the feeding and connection with the driving integrated circuit chip, improved antenna radiation properties were achieved.

What is claimed is:

1. An antenna package, comprising:

an antenna device comprising a dielectric layer and an antenna unit disposed on the dielectric layer, the antenna unit comprising a radiator and a transmission line extending from the radiator; and a circuit board comprising a core layer and a signal wiring disposed on the core layer and electrically connected to the antenna unit, wherein the circuit board has a bonding region adhered to the antenna device, a signal transmission region including the signal wiring and a connect region including a connector connected to a terminal end portion of the signal wiring, and a length of the transmission line of the antenna unit is greater than or equal to a length of the signal transmission region of the circuit board.

2. The antenna package of claim 1, wherein the antenna device has a radiation region in which the radiator is disposed and a transmission region in which the transmission line is disposed; and a length of the transmission region of the antenna device is equal to or greater than the length of the signal transmission region of the circuit board.

3. The antenna package of claim 2, wherein the transmission region of the antenna device includes a bending region.

4. The antenna package of claim 3, wherein the antenna device further comprises an antenna ground layer facing the transmission line with the dielectric layer interposed therebetween in the bending region.

5. The antenna package of claim 1, wherein an area of the signal transmission region is from 50% to 65% of an area of the circuit board in a planar view, and an area of the connector region is from 30% to 40% of the area of the circuit board in the planar view.

6. The antenna package of claim 1, wherein the length of the transmission line of the antenna device is equal to or greater than the length of the signal wiring of the circuit board.

7. The antenna package of claim 6, wherein the antenna unit comprises a plurality of antenna units arranged in a width direction; and the signal wiring of the circuit board is individually connected to the transmission line included in each of the plurality of antenna units.

8. The antenna package of claim 1, wherein the antenna unit further comprises a signal pad electrically connected to an end potion of transmission line in the bonding region; and a ground pad disposed around the signal pad and spaced apart from the transmission line and the signal pad.

9. The antenna package of claim 8, wherein the circuit board further comprises a bonding pad disposed around the signal wiring in the bonding region and electrically connected to the ground pad.

10. The antenna package of claim 9, wherein the circuit board further comprises a ground layer facing the signal wiring in a thickness direction with the core layer interposed therebetween.

11. The antenna package of claim 10, further comprising a via structure penetrating the core layer to electrically connect the bonding pad and the ground layer with each other.

12. The antenna package of claim 1, further comprising a driving integrated circuit chip electrically connected to the antenna unit through the connector.

13. The antenna package of claim 12, further comprising a chip mounting board on which the driving integrated circuit chip is mounted, the chip mounting board comprising a chip connector coupled to the connector.

14. An image display device, comprising:

a display panel; and the antenna package of claim 1 disposed on the display panel.

15. The image display device of claim 14, wherein the radiator of the antenna device is disposed on a front portion of the display panel; and a portion of the antenna device in which the transmission line is disposed is bent toward a rear portion of the display panel.

16. The image display device of claim 15, wherein the circuit board and the antenna device are bonded to each other at the rear portion of the display panel.

* * * * *